US005752449A

United States Patent [19]

Simon et al.

[11] Patent Number: 5,752,449

[45] Date of Patent: May 19, 1998

[54] WORKING TABLE

[75] Inventors: Peter Simon; Ralf Linck, both of München, Germany

[73] Assignee: Knürr-Mechanik für die Elektronik Aktiengesellschaft, München, Germany

[21] Appl. No.: 492,063

[22] PCT Filed: Jan. 28, 1994

[86] PCT No.: PCT/EP94/00238

§ 371 Date: Jul. 21, 1995

§ 102(e) Date: Jul. 21, 1995

[87] PCT Pub. No.: WO94/16597

PCT Pub. Date: Aug. 4, 1994

[30] Foreign Application Priority Data

Jan. 29, 1993 [DE] Germany ..... 93 01 248 U
Jan. 29, 1993 [DE] Germany ..... 93 01 249 U

[51] Int. Cl.[6] ..... A47B 35/00

[52] U.S. Cl. ..... 108/50.02; 108/153.1; 108/64

[58] Field of Search ..... 108/50, 7, 10, 108/153, 180, 147, 64, 50.01, 50.02, 153.1; 312/223.3, 195, 194, 223.6

[56] References Cited

U.S. PATENT DOCUMENTS

| | | | |
|---|---|---|---|
| 4,433,630 | 2/1984 | Laborie | 108/50 |
| 4,748,913 | 6/1988 | Favaretto et al. | 108/153 X |
| 4,838,177 | 6/1989 | Vander Park | 312/195 X |
| 4,875,418 | 10/1989 | Moeckl et al. | 108/50 |
| 4,879,955 | 11/1989 | Moll et al. | 108/50 |
| 5,224,429 | 7/1993 | Borgman et al. | 108/50 X |
| 5,237,935 | 8/1993 | Newhouse et al. | 108/50 |
| 5,394,809 | 3/1995 | Feldpausch et al. | 108/50 X |
| 5,443,017 | 8/1995 | Wacker et al. | 108/50 X |
| 5,544,593 | 8/1996 | Canfield et al. | 108/50 |
| 5,588,376 | 12/1996 | Seidl et al. | 108/50 X |

*Primary Examiner*—Jose V. Chen

*Attorney, Agent, or Firm*—Evenson, McKeown, Edwards & Lenahan, PLLC

[57] ABSTRACT

A working furniture item or table has a modular construction and is usable as an office and conference table and as a work place for electronics engineers, computers, laboratories and technicians. In order to create a working table which functions correctly and which is subsequently reequippable to comply with individual ergonomic requirements, vertical sections associated with a table top have, in their cavities, a vertical adjustment device for a table top arranged as a first working plane. A horizontal cable duct transverse beam is provided as a reinforcing connection between the vertical sections on either side of the table top. The beam permits an integrated cabling or wiring with further working planes arranged in accordance with an ergonomic space concept.

35 Claims, 9 Drawing Sheets

WORKING TABLE

Figure 1A:
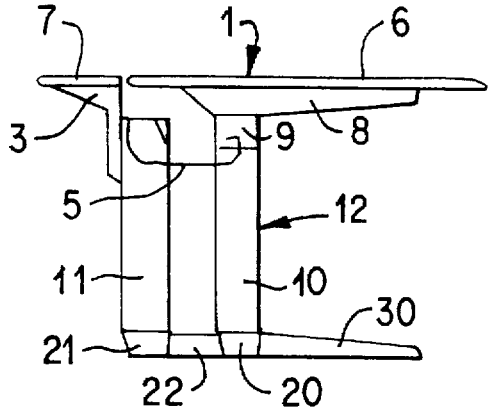

The invention relates to a working table according to the preamble of claim 1.

Various furniture means and programmes with working furniture items and in particular working tables are known for office and conference rooms and for laboratory, technician and computer work places. In order to meet the needs of the different work places, modular furniture systems have been developed. Although this makes it possible to assemble according to the particular needs working furniture items on the basis of the building block principle and often allowing subsequent reequipping, particularly with a second plane, the installation and assembly of additional equipments, e.g. power supply devices, ventilating devices and various laboratory equipments, said known working furniture items do not meet the constantly increasing functional and ergonomic demands, as well as the requirements for an optimum space utilization and at the same time an attractive and flexible design.

The object of the invention is to provide a modular working furniture item or table, which can be assembled both as an attractive office and conference table, and as a stable and optically attractive computer, laboratory and technicians work place and which can be subsequently reequipped in a particularly simple manner. It must also be usable in an optimum manner and which has a height and depth in accordance with technical and ergonomic work place requirements and which can be subsequently adapted to changing demands at limited costs.

According to the invention this object is achieved by the features in the characterizing part of claim 1. Appropriate and advantageous developments are contained in the subclaims and the specific technical description.

According to the invention with a space-ergonomically designed working table, the vertical sections of the support feet in each case have a central inner space, in which is located an inner tube. The inner tube is connected to an associated support arm of the table top and is vertically adjustable by means of a sliding guide for adjusting the height of the at least one, front table top.

The working table, which has a table top resting in the vicinity of its lateral edges on support arms, support feet with vertical sections having T-slots located below the support arms and inner spaces, as well as horizontal foot brackets can have, in addition to a first working area or a table top defining a first working plane, further working planes, which are arranged or constructed taking account of an ergonomic gripping line.

In the vicinity of the table top and further horizontally arranged working planes and/or in the vicinity of the vertical sections can be provided cable spaces, which permit a flexible and integrated cabling or wiring. For stabilizing the vertical sections spaced virtually in the table width in the rear area of the table top is provided as a reinforcing connection a transverse beam, which is connected to the vertical sections and is usable as a horizontal cable space, channel or duct.

The vertical sections are preferably constituted by extruded aluminium sections or profiles, which permit a connection with further components of the modular system. In a particularly advantageous construction the vertical sections have an almost rectangular cross-section with bevelled or rounded corner areas, with T-slots in both lateral faces and with a T-slot in the front faces, the lateral faces of the vertical sections on the working table according to the invention running parallel to the lateral edges of the table top or aligned therewith. A centrally positioned inner space is constructed in complementary manner to a vertically adjustable inner tube and e.g. has a rectangular cross-section.

For obtaining a sliding guide on the inner tube can be provided sliding faces or elements, particularly made from plastic. For example, fixing by means of an adhesive, plug-in or locking connection is possible. The sliding faces or elements advantageously simultaneously serve to compensate tolerances and clearances. For sliding guide purposes it is also possible to use permanent sliding faces or vertical elements, which e.g. in T-shaped manner project into the inner space in such a way that the inner tube is slidingly guided on the crossbar.

In a particularly appropriate construction half-shell-like sliding elements are provided on circular cavities of the vertical section. The circular cavities are in particular constructed in the vicinity of the front faces of the vertical section and bound the central inner space.

The vertical adjustment of the at least one table top can take place steplessly or continuously and cover a range of 680 to 810 mm. However, this vertical adjustment can also take place in spaced manner, e.g. with a grid or raster size of 30 mm or in fixed heights, e.g. a height of 720, 750 or 780 mm and can be manually operable, e.g. using a crank or with the aid of a motor and with a spindle or a cylinder-piston unit located in the lower region of the support feet or the vertical sections.

To permit an easy operation and handling of the vertical adjustment device, the hand or motor control is appropriately located on the front of the table and is easily accessible.

If the vertical adjustment device of the working table includes an indicating device, in a particularly efficient manner an ergonomically favourable table height can be set and checked. Particularly if several persons are working at one work location, it is advantageous to have an indicating device for the table height to be set. The indicating device can be located in the vicinity of the vertical sections or in the vicinity of the operating elements for the vertical setting.

A cable duct transverse beam, which in each case connects two parallel support feet arranged on either side of the table top, is fixed in a first embodiment of the working table in the upper area of the vertical sections of the support feet, preferably using fastening elements, which are retained in the T-slots of the vertical sections.

In a stable construction particularly suitable for technician, EDP or CE work places the working table is provided with double support feet, which for stabilization purposes are connected to a common, e.g. trough-shaped transverse beam. The transverse beam simultaneously usable as a horizontal cable duct in each case connects pairwise succeeding and spaced vertical sections over the entire table width with the double support foot located on the opposite side to give an extremely robust substructure. The cable duct is in particular constructed in stepped, trough-shaped manner and runs in a preferred construction below the rear longitudinal edge of the table top.

The table top is provided as a first, front working plane of the work place and can not only be constructed in a vertically adjustable manner, but optionally also in inclination-adjustable and/or forwardly displaceable and extendable manner. An inclination adjustment can e.g. be obtained with the aid of a pivot pin, cooperating with the support arms, in a connecting area of the inner tube.

A horizontal adjustability can be attained by means of slide rails in the vicinity of the support arms. In a preferred embodiment the table top as the first working plane can be drawn out in the forwards direction and optionally also removed by means of a sliding plate guide. The sliding plate guide can e.g. be constructed as a split ledge with a sliding plate guide located in the front table area and with a sliding plate guide located in the rear table area. The ledges or sliding plate guides are inserted and partly screwed down from below with pins in bores of the table top. For limitation purposes and for safe drawing out, the front sliding plate guide has locking elements, e.g. locking springs. The latter projects downwards and on drawing out the table top to a specific extent engage with a corresponding countermember or a bearing surface in the vicinity of the support arms. As the sliding guides are provided with longitudinal openings, it is possible to press in or raise the locking springs from below, so that the table top can be extended further forwards or completely drawn out.

For the horizontal, trough-shaped cable duct support a cover is appropriately provided and can be constructed in a removable or upwardly pivotable manner. A horizontal gap, extending over virtually the entire cover, for inserting and removing cables and lines is equipped with a sealing cable bushing, e.g. with double sealing lips or brush strips, so that a correct wiring from and to equipment of a work place is ensured.

A gap provided in the vicinity of a double support foot between two successively arranged, spaced vertical sections and which for improving the optical-esthetic overall appearance is covered with a specially designed facing, is appropriately used as a vertical cable duct. For a correct-shaped connection between the vertical and horizontal cable ducts matched to the design of the support arms a facing is provided in the upper area, which can have a removable surface or predetermined braking points for braking purposes and for guiding the cable from the vertical into the horizontal cable duct.

It is advantageous that the vertical sections, particularly the rear vertical sections of the double support feet can be used for increasing the working surface and for equipping the work place, in addition to the front, first working plane, with a second, rearwardly connecting working plane and/or with a table structure as a third, superimposed plane.

A working table with a vertically and/or inclination adjustable second plane can in particular be used for CAD work places, in which the second plane serves to receive monitors and can be adjusted as regards height and inclination to comply with individual wishes.

A transverse beam running between the first and second planes is advantageously used as a cable duct for equipments and devices located on both planes.

For example, a horizontal cable duct provided as a reinforcing connection or transverse beam between vertical sections spaced in the table width can be formed from several longitudinal sections, which are detachably interconnected at their longitudinal edges accompanied by the formation of an approximately triangular cross-section.

It is advantageous to use at least one basic section for fixing to the vertical sections of the support feet on both sides. For this purpose the basic section is provided with a fastening area, which can e.g. be constructed as a cavity for receiving an adaptor-like connecting element. The connecting element can be fixed in the T-slots of the vertical section and with the aid of a clamping part in the cavity of the basic section in order to securely hold the cable duct.

Appropriately the basic section as a corner section and by means of terminal snap seat connections is connected with a somewhat arcuately directed cover or with a rear section or an intermediate section serving to widen the cable duct. For stability reasons the longitudinal sections more particularly made from aluminium are constructed as hollow sections, which for the optional fastening of accessories, e.g. sockets, cable mounting supports, etc., have T-slots and/or screw channels.

For covering the vertical cable ducts, which are constructed in the space between double support feet or in a faced, rear area of a support foot, it is possible to fit colour-differentiated or specially designed caps. The caps are provided with locking elements and can be clipped in. Appropriately use is made of a support frame-like element, which has recesses and projections for retaining cover and lateral faces.

For the formation of a third plane, e.g. for a CE work place with control engineering functions or for forming a function partition or the like, the rear vertical sections of the double support feet can be provided with in particular self-centring extension sections.

In order to ensure a uniform appropriate overall impression, the extension section has almost the same construction as the vertical section of the support or double support feet. In particular for a third working plane directly connected to a rear area of the front table top, it is particularly appropriate to have an inwardly open extension section. Thus, in a particularly rational manner, cables can be passed from the vertically positioned sections into the horizontal cable ducts or supports or directly to the equipment.

If the third working plane is not directly connected to the front table top or surface, it is appropriate to use an elastic, detachable cover on the longitudinal side extension section opening. Advantageously so-called soft lips or brush strip means can be provided for elastic covering and cable guidance.

For example, it is possible to fix to upwardly extended vertical sections a cross-brace, which serves as an adjusting plane or depositing member for receiving different subassemblies, components and/or equipments.

Advantageously use is made of a construction of an upper reception plane as a horizontal, upper cable duct, which e.g. has a downwardly pivotable casing bottom with holding or guiding elements. In order to improve the operation for reading off of equipments located on the third plane, it can also be given an inclination-adjustable construction, the standard equipments being fixed on or in the vertical sections of the third plane.

A table top extending to the rear vertical sections and which is provided as a first, front working plane is appropriately provided in the vicinity of the rear vertical sections with complementary recesses with respect to the cross-section of the vertical sections. When using the table top for a work place without table structure or without a third plane, these recesses are appropriately covered with a detachable, plate-like insert which can be locked or slid in. The in each case upper, open front faces of the vertical sections, for the purpose of giving an attractive design to the work place, are provided with a plate-like cover cap adapted to the contour of the vertical sections and which can be pressed e.g. with studs into circular inner spaces of the vertical sections.

In a further development of the working table an ergonomic design is associated with a particularly effective surface or space utilization and an extremely advantageous work place design is created.

According to this under space-economic and ergonomic aspects in the work place, a casing area is provided for receiving equipments, which are almost outside a viewing or gripping area, so that in particular the table top as the first, front working plane is free from equipments. The work place space concept according to the invention provides a fourth plane, which is essentially located in the lower area below the table top and receives basic supply equipment, such as PCs, plug-in cards, power supply means, transformers, etc. As a second plane can be provided a rear table top, whereas a connecting field is located in the ergonomic gripping area and e.g. receives equipments, such as in particular measuring and indicating equipments.

A particularly effective space utilization is obtained if the indicating or display unit, particularly a monitor, is fixed outside the front table top, e.g. is pivotably fixed to an extension section of the third plane.

The entire table surface or work plate as a first plane in this work place space concept remains free for one or more testpieces and for additional means, e.g. circuits or special devices. A casing construction of the fourth plane permits an effective r.f. shielding of the different equipments, which can also be protected against one another by a r.f. shielding. Thus, for test places there is a reduction in the fault probability and losses. Controllable ventilator systems can be installed in order to prevent any heat accumulation and at the same time ensuring minimum noise levels. A uniform service and maintenance concept can be obtained, which reduces maintenance costs. Through a uniform operation of the equipments, particularly with a corresponding programme, faults are reduced and shorter working-in times are possible.

Appropriately there is an integrated cabling or wiring, which also includes bus systems and a linking of computers. This improves the transmission possibilities for test data, their detection, evaluation and processing. A further advantage is a better production monitoring. The integrated wiring means reduced fault susceptibility of the overall equipment complex and work place and a more rational testing. An unintentional detachment of cables or wires is virtually impossible.

An important effect of the integrated arrangement of personal computers, basic supply means, etc. is a reduced space requirement, an extremely stimulating overall impression of a work place and material savings due to the omission of individual casings or housings.

According to a further development the working table incorporates at least one cupboard or cabinet located below the table top and in particular in the form of a roll container, which can extend close to the table top and which is provided with a complementary cover or top area in an appropriate adaptation to a stepped, trough-shaped cable duct support and/or to an equipment area forming a fourth plane. In a particularly simple manner this design permits an optimum positioning of such a cupboard or roll container and it is also possible to provide a fixing, e.g. with the aid of a Velcro closure to the rear cable duct support. The said cupboard or roll container can be constructed as a function of the work place requirements so as to be able to receive different attachments, e.g. open trays for office material or in basket-like manner and/or with attachments equipped with mats. If below the table top there is a further table plane, e.g. an extendable table plane, the roll container has a correspondingly reduced height. In a further development of the working table in the vicinity of the front longitudinal edge of the table top are provided plug-in, so-called active edges, which are constructed for receiving additional deposition possibilities, e.g. insert trays.

The working table according to the invention can in a particularly simple and optically attractive configuration be located in a corner combination. A corner table top is fixed by its support arms to the inner tube of the associated vertical section, if the corner table top together with the laterally adjacent table tops is to be vertically adjustable. Otherwise there can be a fixing in longitudinally grooves of the vertical sections.

It is particularly advantageous to use support feet or double support feet, which are provided with detachable and/or replaceable foot brackets and which can be dismantled and re-fitted in use position of the working table without particular effort and expenditure. A particularly appropriate construction of a base element, which connects a vertical section to a horizontal foot bracket, and a terminal connecting area of said foot bracket ensure a self-centring and self-arresting reception and uncomplicated fixing. Thus, a modification to a foot bracket can take place without disturbance during a testing process or during measurement and the like.

In the vicinity of the corner combinations it is e.g. possible to avoid relatively long, front and disturbing foot brackets, which can be replaced by shorter foot brackets.

Particularly in the case of working furniture items or tables, which must meet numerous different demands and varying design concepts within a modular work place system, a need for a reconstruction may arise, e.g. the installation of a further working plane for housing additional equipments. A deeper work plate than the first working plane or a table top structure as the third working plane can then make necessary for the purpose of ensuring an adequate stability the installation of a longer or an additional, rear foot bracket.

A particularly simple construction and extremely simple fitting and dismantling of a foot bracket is ensured if a vertical section of a support foot associated with the table top is connected to a horizontally positioned foot bracket, which is removable and replaceable in the working table use position. If a base element constructed in complementary manner to the vertical section is positioned below the latter and is e.g. detachably connected thereto by means of screw connections, as well as having a front insertion opening and an easily accessible connecting area, it is possible to horizontally slide in and fix in the base element a foot bracket, which has a connecting block. A particularly advantageous detachable fixing is achieved on the connecting area of the base element or on the connecting block of the foot bracket by means of an inclined screw connection. For particularly stable working tables bringing about an optimum space concept it is possible to use base connectors, which connect in spaced manner two vertical sections of a double support foot. If necessary, a shorter foot bracket can be inserted in the rear base element. For manufacturing and material-economic aspects the use of a bottom-open U or double-U section, particularly an aluminium, die cast or sheet steel deep-drawn part is advantageous. The base element is appropriately a bottom-open casting. The foot bracket and base element construction permits a particularly easy fitting and random replacement of a foot bracket in situ without complicated reequipping activities. The insertion opening of the base elements can appropriately be closed with the aid of cover elements, if no foot bracket is provided.

The invention is described in greater detail hereinafter relative to the attached diagrammatic drawings, wherein show:

FIGS. 1*a* to 1*f* Variants of the working table according to the invention.

Figure 2:
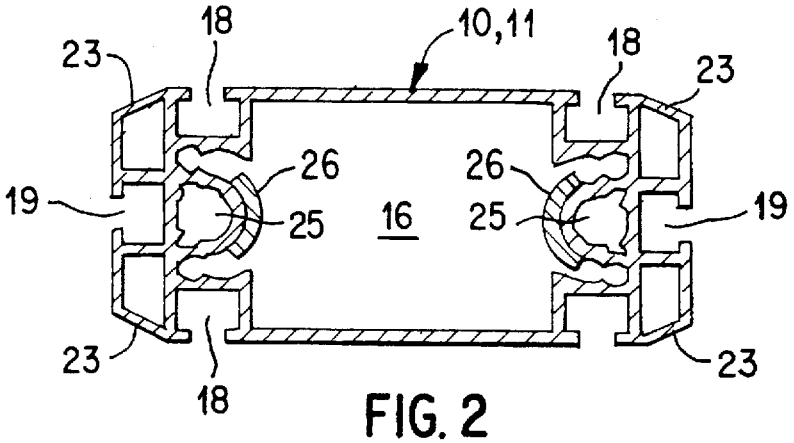

FIG. 2 A cross-section through a vertical section of the working table according to the invention.

Figure 3:
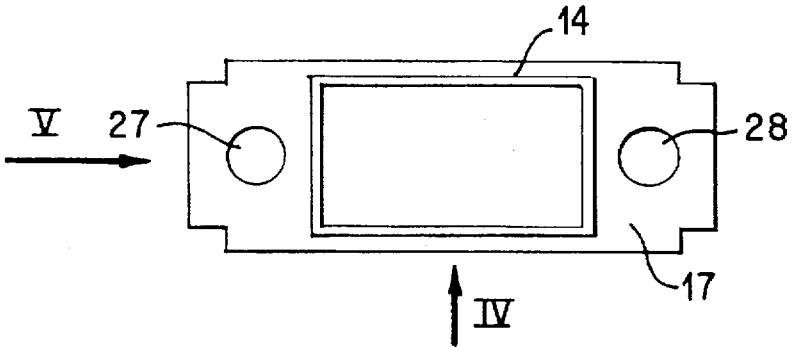

FIG. 3 A plan view of an inner tube.

Figure 4:
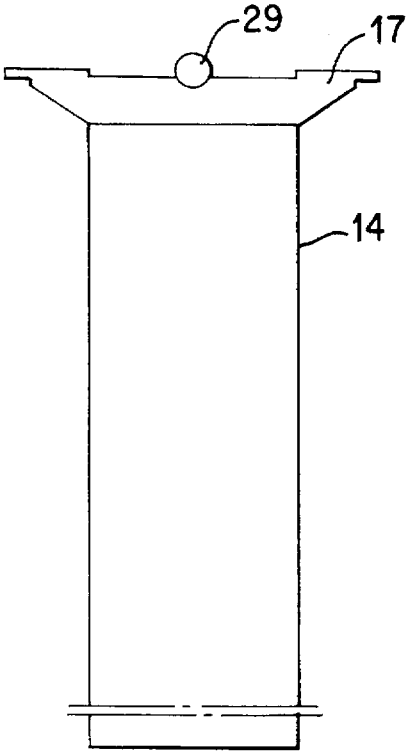

FIG. 4 An elevation along arrow IV of FIG. 3.

Figure 5:
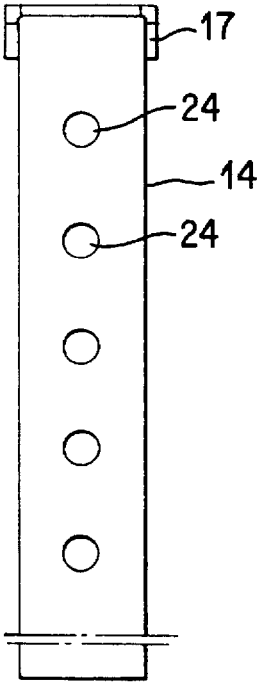

FIG. 5 An elevation along arrow V in FIG. 3.

Figure 6:
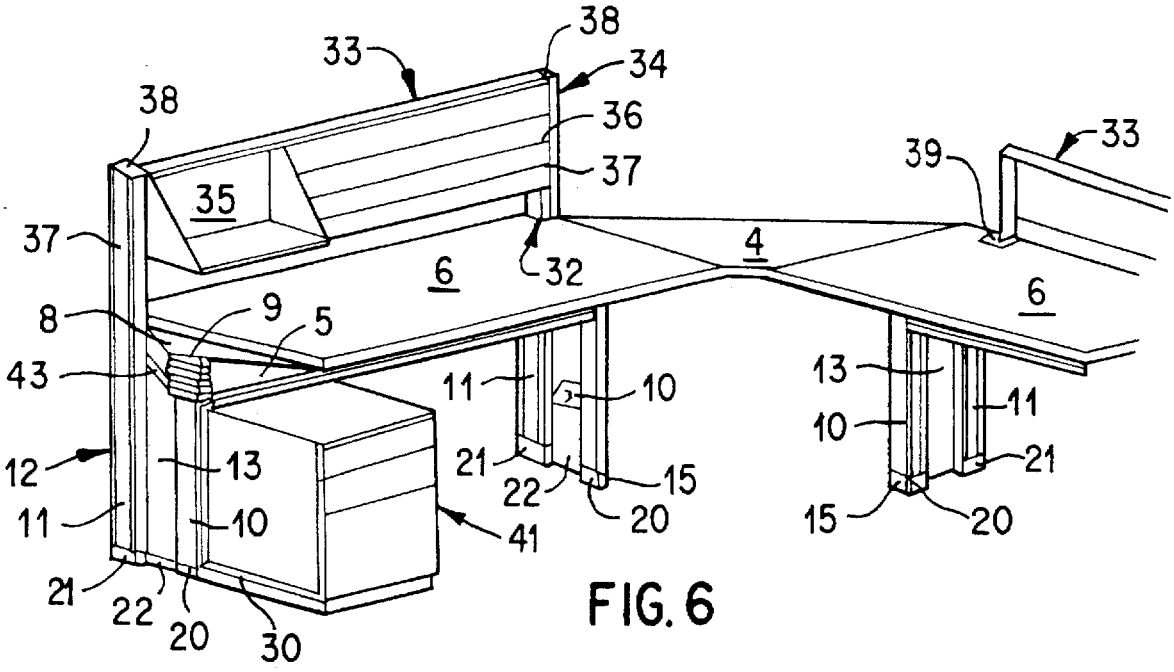

FIG. 6 A perspective view of an office corner combination with a first variant of the working table according to the invention, which is also equipped with an under-table cupboard and a function partition.

Figure 7:
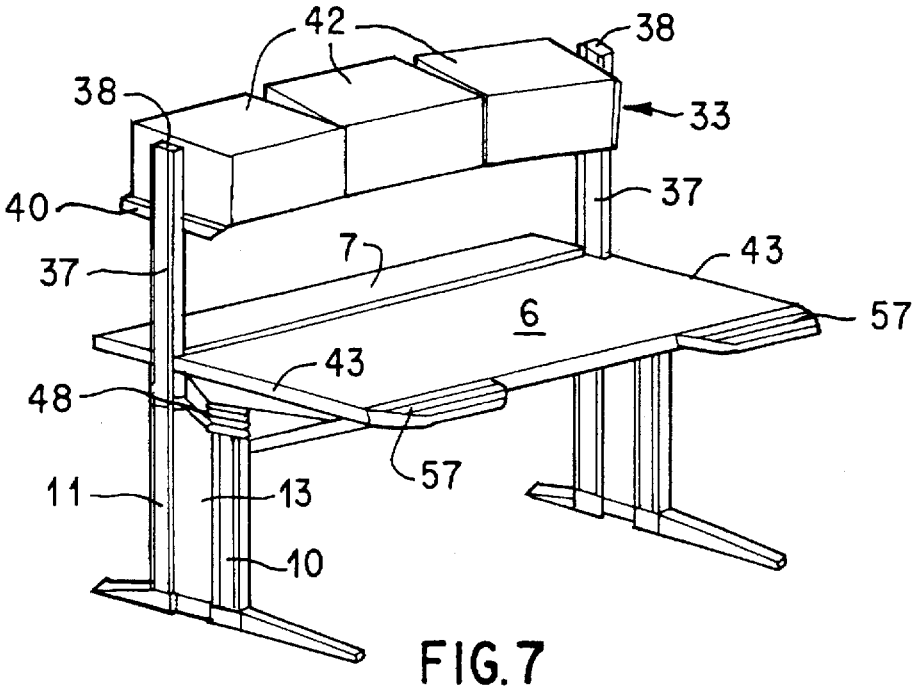

FIG. 7 A perspective view of a working table according to the invention having three working planes in a first variant.

Figure 8:
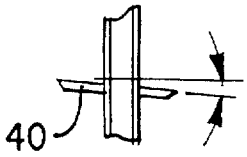

FIG. 8 A detail of FIG. 7 in the vicinity of a third working plane.

Figure 9:
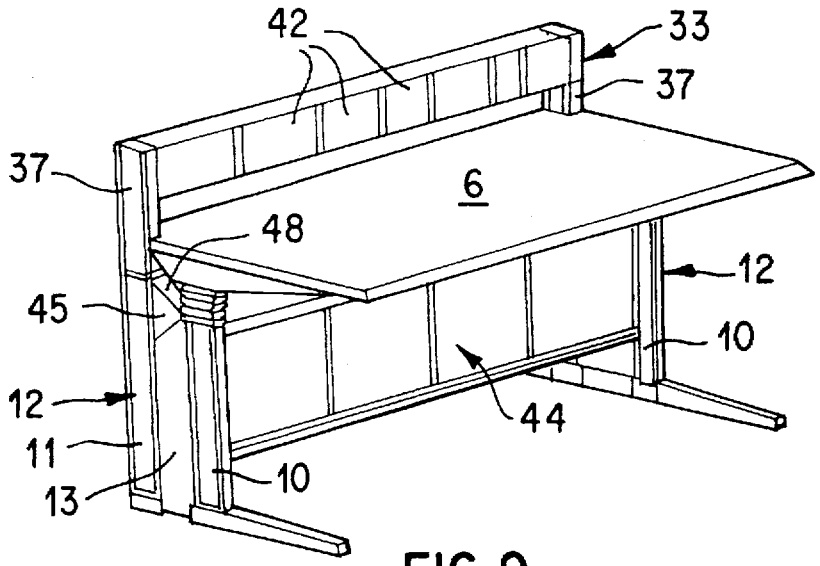

FIG. 9 A perspective view of a laboratory work place according to the first variant with a first and third working planes.

Figure 10:
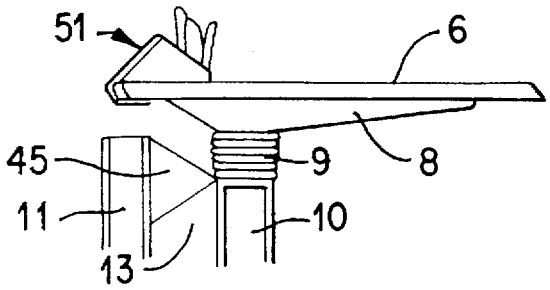

FIG. 10 A side view of an office working table according to a first variant in the vicinity of the rear longitudinal edge with a displaceable arrangement for small office items.

Figure 11:
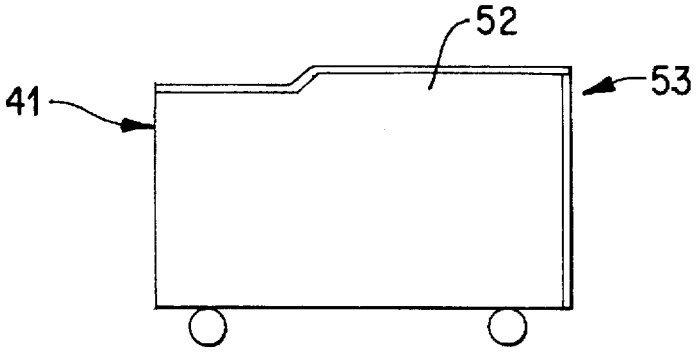

FIG. 11 A side view of a roll container as a displaceable under-table cupboard.

Figure 12:
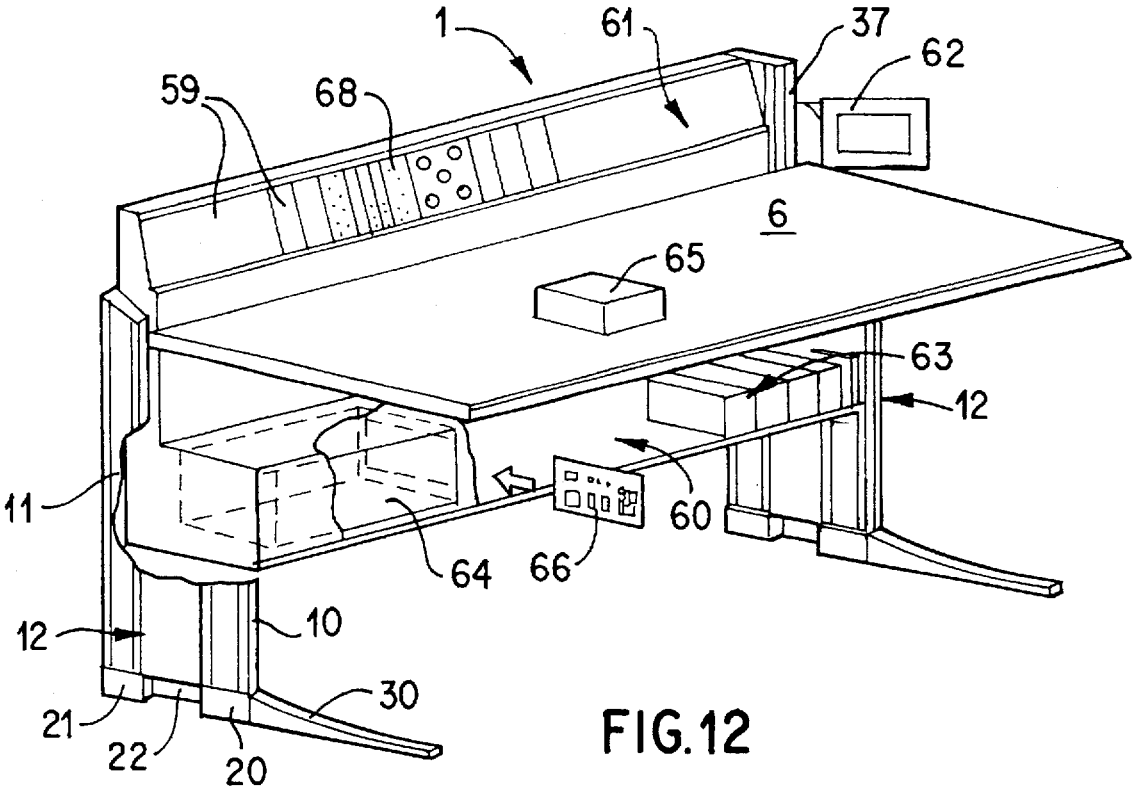

FIG. 12 A perspective view of an electronics engineer testing work place according to an ergonomic space concept.

Figure 13:
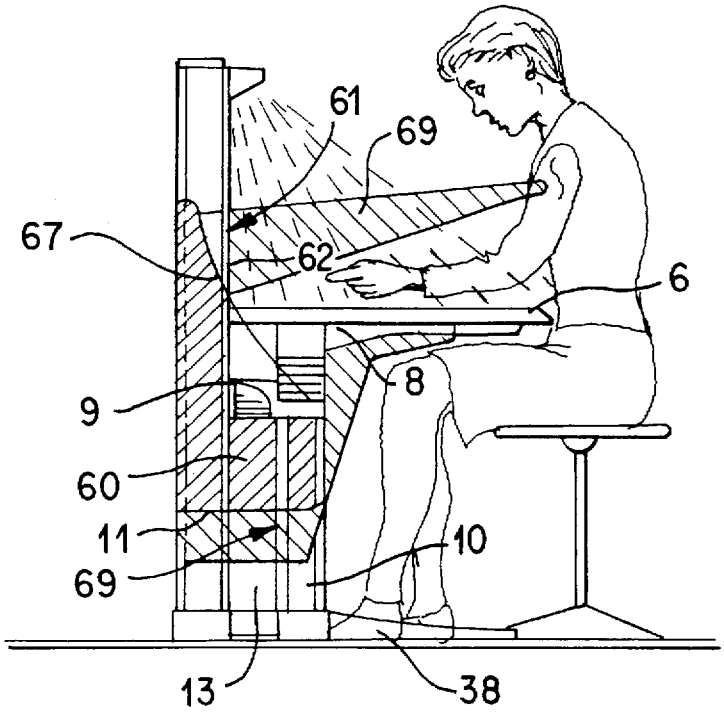

FIG. 13 A working table like FIG. 12 with a diagrammatic view of an ergonomic gripping line of a gripping area and a casing area of a fourth plane.

Figure 14:
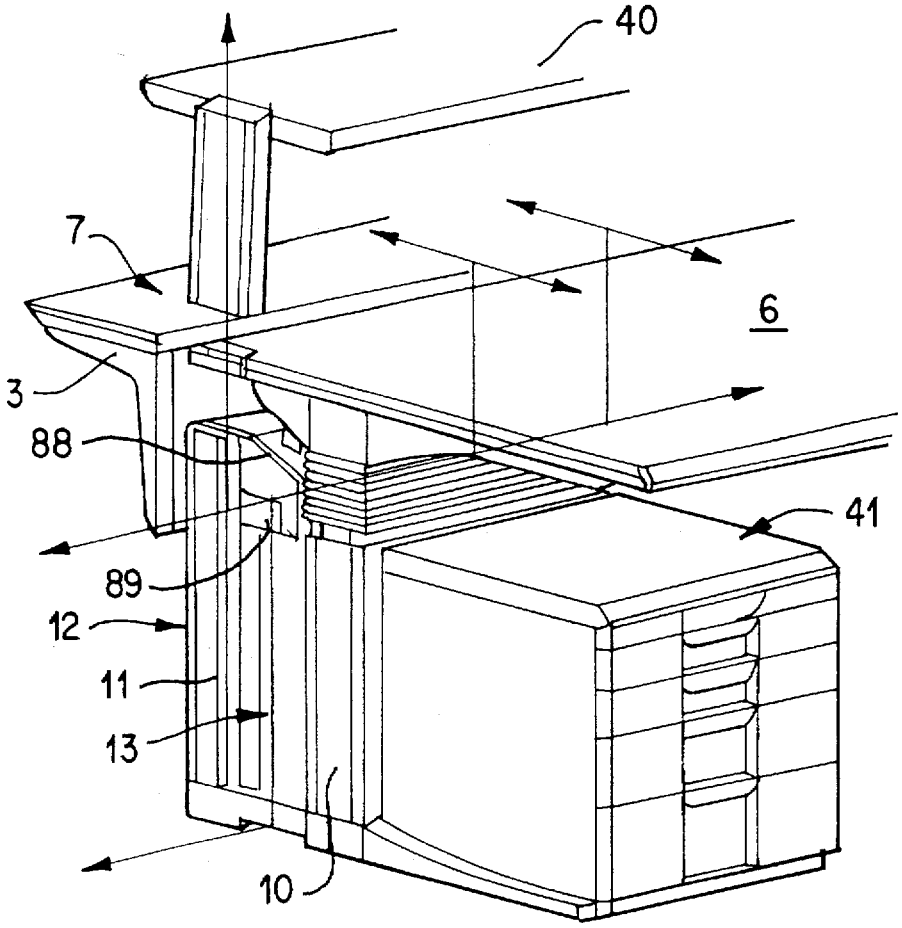

FIG. 14 A perspective view of an integrated cabled working table.

Figure 15:
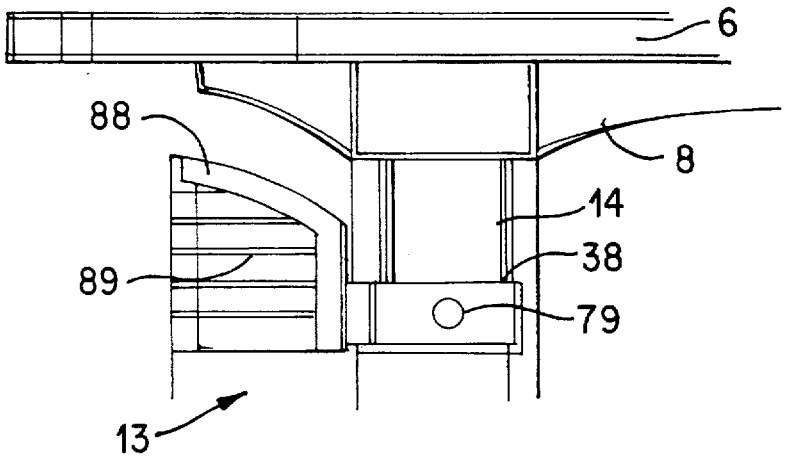

FIG. 15 A side view of a working table according to the invention with raised table top and indicating device.

Figure 16:
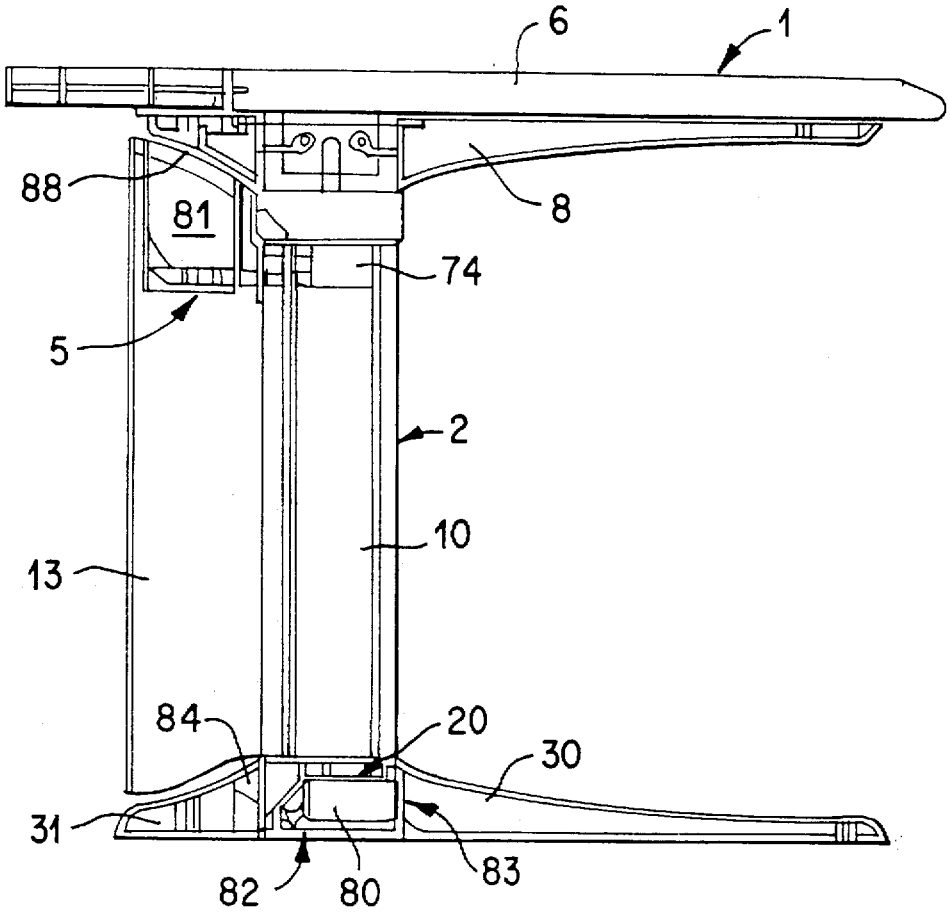

FIG. 16 A part sectional side view of a working table with a first working plane, with a variable-design horizontal cable duct and replaceable foot brackets.

Figure 17:
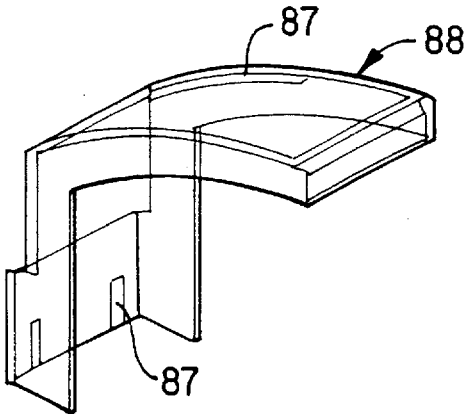

FIG. 17 A perspective view of a cable duct cap.

Figure 18:
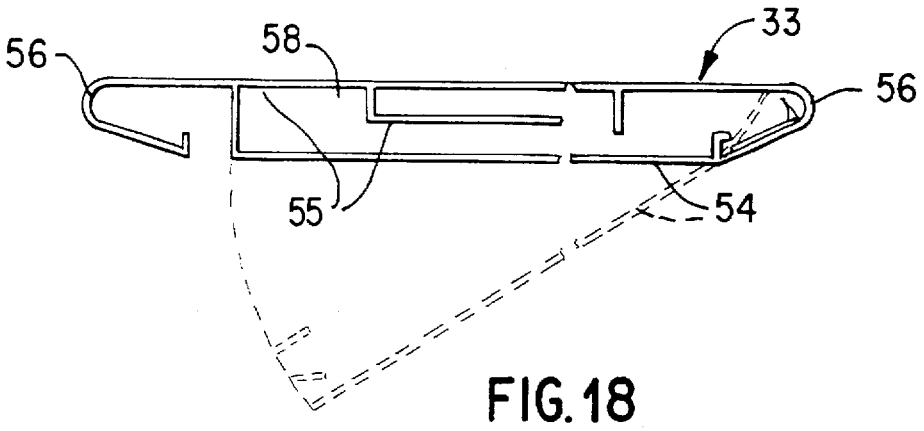

FIG. 18 A vertical section through a third plane of a working table according to the invention constructed as a horizontal cable duct.

Figure 19:
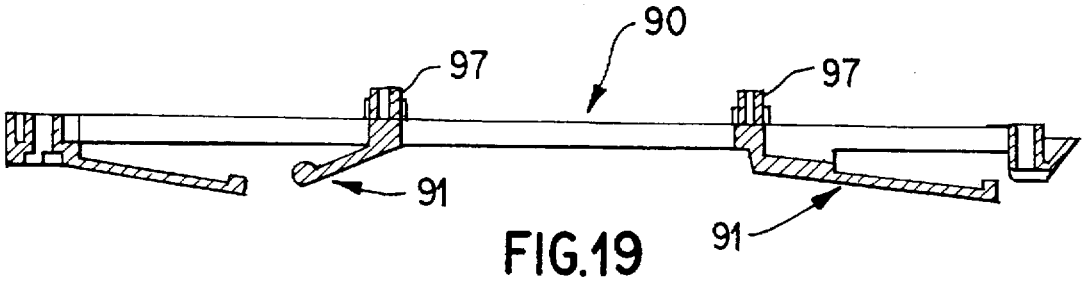

FIG. 19 A vertical longitudinal section through a front sliding plate guide of a table top.

Figure 20:
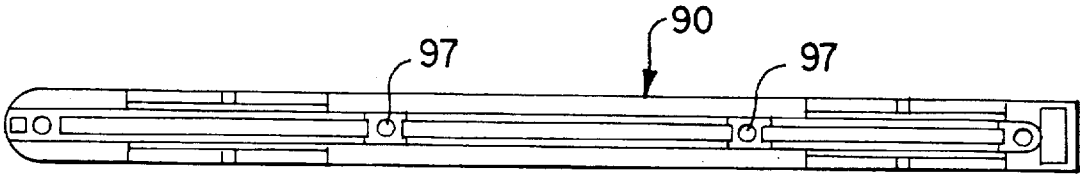

FIG. 20 A plan view of a sliding plate guide according to FIG. 19.

Figure 21:
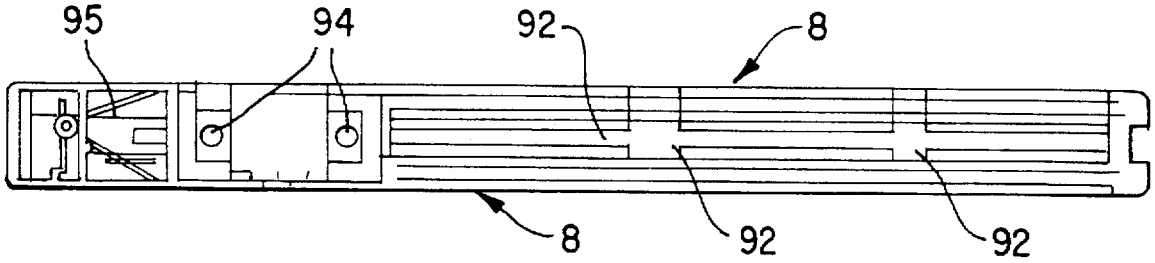

FIG. 21 A plan view of a support arm of a table top.

Figure 22:
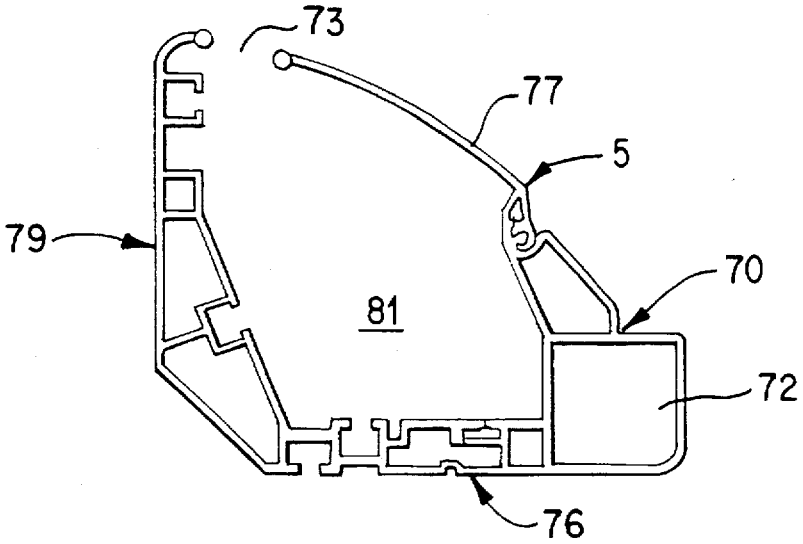

FIG. 22 A cross-section through a horizontal cable duct transverse beam.

Figure 23:
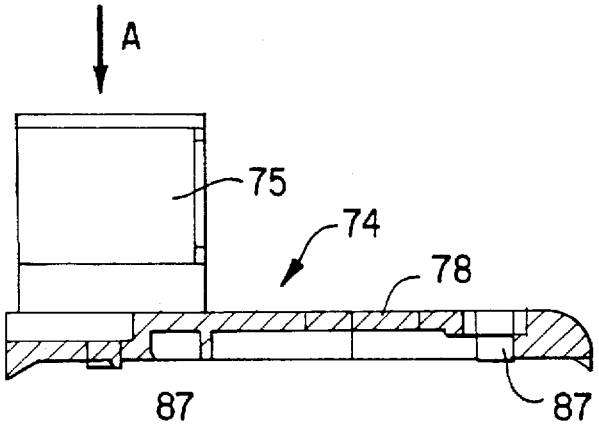

FIG. 23 A vertical longitudinal section through a connecting element for fixing a cable duct transverse beam according to FIG. 18.

Figure 24:
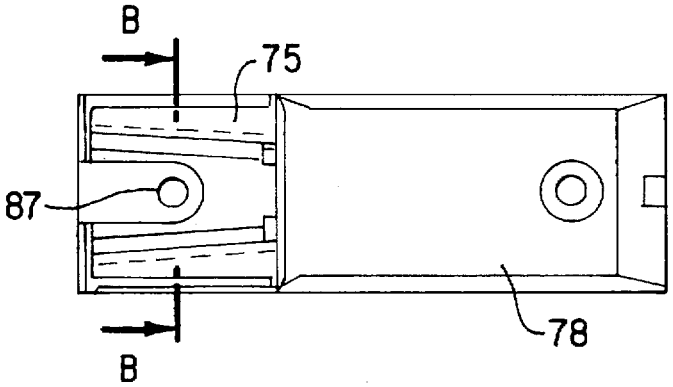

FIG. 24 An elevation along arrow A of FIG. 23.

Figure 25:
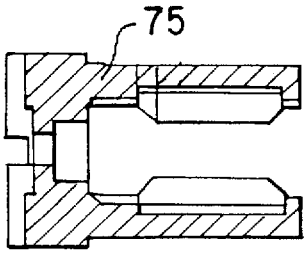

FIG. 25 A cross-section along line B—B in FIG. 24.

FIGS. 1*a* to 1*f* show in exemplified manner variants of a working furniture item or table according to the invention, which has a modular construction and can be equipped with different components as a function of the intended use. Fundamentally, a working table 1 according to the invention has a table top as the sole or front, first working plane and which in the vicinity of its lateral edges rests on wedge-shaped support arms 8 and is vertically and/or inclination-adjustable and/or is extendable forwards, e.g. by 20 cm. The extendability can be achieved by means of sliding guiding elements between the underside of the table top 6 and the support arms 8.

The table top 6 is supported by means of the support feet 2 connected to the support arms 8 or by means of double support feet 12, which are provided with at least one horizontal foot bracket 30, a base element 20 and a vertical section 10. In an advantageous development the foot bracket 30 is given a wedge-shaped construction in the same way as the virtually identically long support arm 8 and gives with T-slots 18 (cf. FIG. 2) constructed longitudinally on the vertical sections 10, a functionally and optically attractive overall impression.

FIG. 1*a* shows a work place for a technician with a double support foot 12 and a transverse beam 5, which is constructed in a stepped, trough-shaped manner, which serves as a supporting element and cross-brace and is simultaneously usable as a horizontal cable duct. The transverse beam 5 is fixed with lateral front faces (not shown) in the T-slots 18 (FIG. 2) of the lateral faces of the front vertical sections 10 and the identically constructed, rear vertical sections 11. The work place according to FIG. 1*a* has a particularly deep, vertically adjustable table top 6 as a first working plane and a rearwardly connecting table top 7 as a second working plane, which by means of an angle element 3 is fixed rigidly or in height-displaceable manner on the rear vertical section 11, e.g. in its T-slots 19 (cf. FIG. 2). Alongside the front base element 20, the double support foot 12 has a rear base element 21, which forms with a base connector 22 a unit and forms together with the cable duct transverse beam 5 a stable substructure for the working table and in the present embodiment for a work place for a technician. The elements for the vertical adjustment of the table top 6 are positively and detachably covered between the front vertical sections 10 and the support arms 8 with a flexible sealing element, e.g. with a rubber bellows 9 or also a rubber sleeve.

Figure 1B:
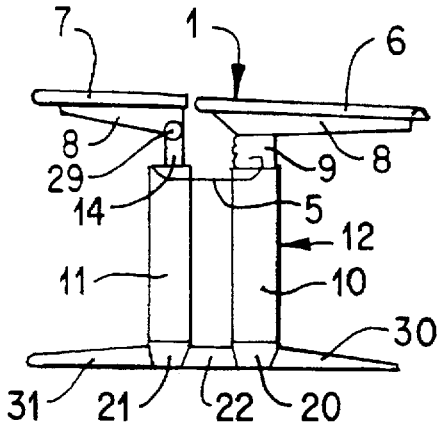

FIG. 1*b* e.g. shows a CAD work place, which also has a double support foot 12 and a trough-shaped cable duct transverse beam 5. As a first working plane a front table top 6 is connected in vertically adjustable manner to the front vertical section 10, whilst a second, rear table top 7 is supported in vertically and inclination-adjustable manner by means of a visible inner tube 14 and a pivot pin 29 on a rear vertical section 11. In the same way as the technician's work place according to FIG. 1*a*, a horizontal cable duct transverse beam 5 is used for the supply of the equipments on both the table tops 6, 7. To the depth of the second table top 7 is adapted a rear foot bracket 31, which like a front foot bracket 30, is detachably fixed in an associated base element 20 or 21, the vertical sections 10 or 11 being connected to the respective base elements 20 or 21.

Figure 1C:
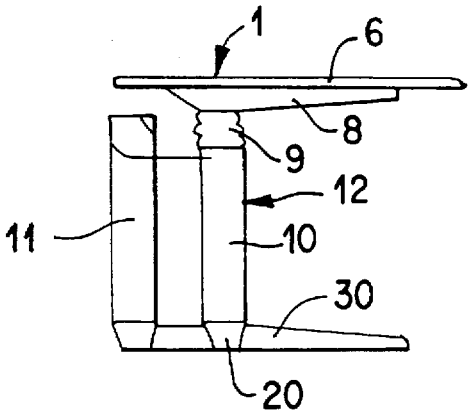

FIG. 1*c* shows another work place for a technician, which is substantially identical to that of FIG. 1*a*, but only has a first working plane in the form of a particularly deep table top 6 extending over the rear vertical sections 11.

Figure 1D:
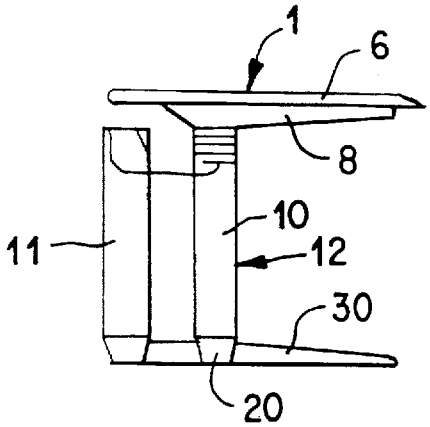

FIG. 1*d* shows an office and technician's work place with a stepwise, vertically adjustable table top 6, whose vertical adjustment will be described in conjunction with FIGS. 2 to 5.

Figure 1E:
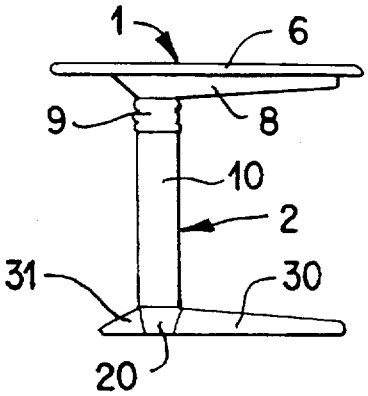
Figure 1F:
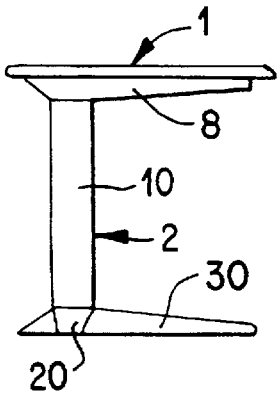

The office table top shown in FIG. 1*e* is provided with a support foot 2 having a front foot bracket 30 and a short, rear foot bracket 31. The table top 6 is vertically adjustable, whereas a conference table according to FIG. 1*f* has a table top 6 rigidly resting on a support arm 8 and supported on support feet 2.

FIG. 2 shows in cross-section the construction of the vertical sections 10, 11 of the support feet 2 or the double support feet 12. The vertical sections 10, 11 have an almost rectangular cross-section, which are provided with bevelled corner areas 23 between parallel lateral faces and/or lateral faces aligned with the lateral edges of the table tops 6, 7, with in each case two T-slots 18 and shorter front faces with in each case one T-slot 19. However, the corner areas 23 can also be rounded. In a central, almost rectangular inner space 16 an inner tube 14 (cf. FIGS. 3 to 5) is guided in vertically adjustable manner by means of a not shown spindle. It is also possible to have two spindles, e.g. in the circular inner spaces 25 of the vertical section 10, 11. The inner tube 14 is a steel tube and is constructed in complementary manner to the inner space 16 of the extruded aluminium section 10, 11. The steel inner tube 14 is stepwise, vertically adjusted by means of a sliding guide, a grid size being predetermined by the spacing of the holes 24 along the inner tube 14 and can e.g. be 30 mm. The inner tube 14 has an upper, enlarged connecting area 17, which is provided with a circular bore 27 and an oval bore 28, which serve to connect to at least one spindle operated with a crank or a motor in an inner space of the vertical section 10, 11. In the connecting area 17 can also be provided a pivot pin 29 for an inclination-adjustable table top 7 (cf. FIG. 1*b*). For the sliding guidance of the inner tube 14 in the inner space 16, adjacent to the latter are provided half-shell-shaped sliding elements 26, which can have separate sliding coverings. Alternatively it is also possible to stick or bond to the inner tube 14 sliding or permanent sliding surfaces.

FIG. 6 shows an office corner combination as a further embodiment for a working table adaptable to work place requirements and space situations. The same reference numerals are used for the same features. To table plates 6, connected and supported by means of support arms 6 with double support feet 12, can be vertically adjusted. For the formation of a third working plane 33, which for the left-hand table top 6 represents a function partition 34 with a file adjusting plane 35 and horizontal slots 36 for fixing various devices, e.g. lamps, viewing panels, etc. (not shown), on the rear vertical sections 11 of the double support feet 12 are plugged self-centring extension sections 47, whose upper front faces are covered with a cover cap 38. In the vicinity of the extension sections 37 a corresponding recess 32 is formed in the table top 6 and is optionally covered with a not shown, plate-like insert. Below the table top 6 in the rear area is provided a cable duct transverse beam 5, which is connected to a vertical cable duct 13 formed by a facing between the front vertical section 10 and the rear vertical section 11.

FIG. 6 shows the optically attractive and esthetic design of an office working table with an additional mounting plane 33. By means of a diagrammatically represented adaptor 39, which is preferably fixed in the rear area of the support arms 8, an additional plane 33 is mounted on the right-hand table top 6. A corner plate 4 is fixed by means of not shown retaining elements to the inner tubes of the adjacent vertical sections 10. To ensure the necessary freedom for the legs the foot brackets have been removed from the front base elements 20 in the corner area. As this can take place in the working table use position, disturbing foot brackets can also be subsequently removed or replaced. The insertion openings of the base elements 20 are covered with a cover element 15, which can contain a levelling screw. For receiving office material below the table top 6 of the left-hand working table is located a cupboard or cabinet 41, whose height at least in a rear area is adapted to the table duct transverse beam 5.

FIG. 7 shows a technicians work place with a table top 6 as the front, first working plane, a rear table top 7 as the second working plane and a relatively high table structure as a third plane 33, which is constructed as an inclination-adjustable plane 40 (cf. FIG. 8) for installed equipments 42. The vertically adjustable table top 6 is provided with two active edges 57, which can be plugged in close to the lateral edges 43 for the easily accessible reception of different equipments. The extensions 37, which are engaged on the rear, vertical sections 11, extend over the pivoted installed equipments 42 and are provided with a cover cap 38. It is advantageous to construct the upper, inclination-adjustable plane 40 as an upper, horizontal cable duct 58 (cf. FIG. 18), which ensures an invisible, protected cable guidance to the equipments of the third plane.

FIG. 9 shows in an improved, ergonomic space concept a working table with under-table cupboard units 44, which are located in the vicinity of the double support feet 12 and are fixed to the vertical sections 10, 11, serving to receive the essential supply means, so that on the table top 6 and a relatively low third plane 33 fixed to correspondingly short extension sections 37 of the rear vertical sections 11, it is only necessary to place additional and in particular indicating or display equipments. A facing fitted in the vicinity of a vertical cable duct 13 is provided with an upper triangular member 45 (FIG. 10), which is equipped with fastening elements for detachable connection to the facing of the vertical cable duct 13 and plug-in elements for retaining in a frontal T-slot 19 of the vertical section 11. For the top covering of the vertical cable duct 13 of a working table a plate-like covering element is fixed in inclined manner to the triangular member 45. It is possible to form a connection between the vertical cable ducts 13 and the horizontal cable duct transverse beam 5 with the aid of an opening in the triangular member 45 formed with the aid of predetermined braking points or a removable surface.

FIG. 10 shows in detail in a side view a rear area of a table top 6, to which is secured a dome-like arrangement 51 for office items. This arrangement 51 is also displaceable along the edge of the table top 6. By means of identically constructed, displaceable table clips pivotable lamps or other table attachments and means can be fixed in adjustable or pivotable manner.

A roll container 53 diagrammatically shown in FIG. 11 has a stepped cover area 52, which is adapted to the stepped, trough-shaped construction of the cable duct transverse beam 5 and permits by abutment a rapid and simple positioning below a table top 6.

FIG. 12 shows in diagrammatic, perspective form a work place for an electronics engineer as a further developed working table 1, which corresponds to an optimized, ergonomic spaced concept. The same reference numerals are used for the same features. What is characteristic of the novel space concept is an equipment-free table top 6, so that space is available for a testpiece 65 on a particularly large working surface.

An equipment-free table top 6 is made possible by using the space below it for a housing or casing area 60 as a fourth working plane. In the casing area 60 are in particular received basic supply equipments, such as regulatable direct current equipments, signal generators, etc., personal computers 64 and other modular means and flexible plug-in cards 66.

Thus, for such work places which are e.g. particularly suitable for the entry and exit of goods and for intermediate checking purposes, a functional and design-optimized construction is obtained. An IP-tight and/or a r.f. shielded casing area 60 can be advantageous for trouble free and fault free testing and inspection.

Besides a table top 6 as a first working plane and the casing area 60 as a fourth working plane along an ergonomic gripping line 67 (cf. FIG. 13) is provided as a third working plane a connection field 61 between extension sections 37 of double support feet 12. In the case of a subdivision into three working appliances 68 are located in the connection field 61, basic supply equipment 63 and voluminous equipment 64 in the casing area 60 below the table top 6 and display units, such as monitors 62 and control units such as keyboards and mouse (not shown) are located outside the table top 6 in an ergonomic gripping area 69 (cf. FIG. 13).

Advantageously the connection field 61 is covered by front panels 59 and is inclined in accordance with the ergonomic gripping line 69.

FIG. 13 shows the novel ergonomic space concept with gripping area 69 and casing area 60, as well as individual features of the design.

In this embodiment a table top 6 is continuously adjustable between a height of min. 680 mm and max. 810 mm. A vertical adjusting device, such as has been described in exemplified manner in conjunction with FIGS. 2 to 5, is located in the vicinity of a front vertical section 10 and is sealed by a rubber bellows 9. A cable duct 13 is provided with a curved cable duct cap 88. The connection field 61 is provided as a third working plane as in the embodiment according to FIG. 12 between the extension sections 37 of the rear vertical sections 11. The foot brackets 30 and support arms 8 are curved.

FIG. 14 provides a view of a working table 1 for an office with a front table top 6 as a first working plane, a rear table top 7 as a second working plane and an adjusting plane 40 as a third working plane, together with a below-table cupboard 41. A vertical cable duct 13 runs between two vertical sections 10, 11 and is provided with a cable duct cap 88 and a specially designed front cover member 89. FIG. 14 shows the cabling and wiring (arrows), which are integrated into the work place and laid in fixed manner. This leads to particularly simple and safe handling and also to a reduction of possible fault and error sources.

FIG. 15 shows a table top 6 adjusted to a fixed height of 720 mm and which projects at the rear over a vertical cable duct 13. A height indicating device 79 is located in the vicinity of a cover cap 38 for a vertical section 10.

FIG. 16 shows a working table 1 with a vertically adjustable and forwardly extendable table top 6 in a part sectional side view, which has a vertical cable duct 13 above a rear foot bracket 31 and a horizontal cable duct transverse beam 5 as a reinforcing connection between the vertical sections 10. The foot brackets 30, 31, support arms 8 and upper end regions of the vertical cable ducts 13 have a curved or arcuate construction.

The cable duct transverse beam comprises hollow sections circumferentially connected by means of snap seat connections (cf. FIG. 22) and is held on the vertical section 10 by means of an adaptor-like connecting element 74 (cf. FIGS. 23 to 25).

In the lower area the vertical section 10 is detachably connected by means of a base element 20 to a front foot bracket 30 and to a rear foot bracket 31. Advantageously the foot brackets 30, 31 can be fitted and dismantled in a particularly rational manner and detachment and removal from the base element 20 can take place horizontally and without changing the position of the working table 1. To this end, e.g. the foot bracket 30 is inserted with a terminal connecting block 80, via a frontal insertion opening 83 into a recess 82 of the base element 20 and is detachably fixed to the latter by means of an easily accessible connecting area 84 with an inclined screw fastening. The rear foot bracket 31 can also be fixed to the connecting area 84 of the base element 20. A connecting block 80 of the foot bracket 30, 31 permits a self-centring and self-arresting fixing on the base element 20.

FIG. 17 shows a lockable cable duct cap 88 having guide slots 87, which, rotated by 180°, can be fixed on a cable duct 13 according to FIG. 16. It is easily possible to see the curved shape corresponding to the design concept of the furniture variant and which continues in the form of a cover 77 of the horizontal cable duct transverse beam 5 (cf. FIG. 22).

FIG. 18 is a diagrammatic vertical section through a third plane 33, which is constructed in casing-like manner and as an upper, horizontal cable duct 58 with a downwardly pivotable casing bottom 54. Guide elements 55 within the cable duct 58 ensure a protective retaining of cables and lines. In an advantageous construction the front and rear longitudinal edges 56 of the cable duct 58 are rounded and wedge-shaped in the same way as the longitudinal edges of the table tops 6, 7.

FIGS. 19, 20 and 21 show a sliding plate guide constructed as a split ledge for a front area of a horizontally displaceable table top 6. With the exception of the locking elements 91, a rear sliding plate guide is constructed identically. The sliding plate guide 90 is fixed by means of studs 97 to the lower, not shown table top 6. The blocking elements are constituted by downwardly projecting slide springs, which during the extraction of a table top slide in longitudinal channels 92 of the support arms 8 and lock in openings 92 with a specific, predeterminable extraction amount. After pressing in the blocking elements the table top 6 can be drawn out further.

The support arm 8 according to FIG. 21 and which is fixed by means of bores 94 to an inner tube 14 of a vertical adjustment means according to FIGS. 3 to 5, is vertically adjustable.

A rear support arm 95 can be covered with a not shown cap, which is displaceably positioned, so that a vertical cable duct running below it is accessible.

FIG. 22 shows in cross-section an advantageous construction of a horizontal cable duct transverse beam 5. The latter comprises several circumferentially detachably connected hollow sections 70, 79, the reception space 81 being enlargeable by an insertable, further, not shown longitudinal section in accordance with demands.

As hollow longitudinal sections are provided in the present embodiment of a cable duct an almost rectangular basic section 70 on which is pivotably mounted a curved cover 77. In the closed state and accompanied by the formation of a gap-like cable bushing 73, the cover 77 extends to a second, rear hollow section 79, which is detachably connected to the basic section 70 by means of an almost centrally positioned clip or snap seat connection 76. In the vicinity of the snap seat connection 76 it is possible to insert a third, not shown hollow section in order to enlarge the cable duct.

The basic section 70 has an almost square hollow space 72 as a fastening area for receiving an adaptor-like connecting element 74, which is diagrammatically shown in FIGS. 23 to 25.

The connecting element 74 according to FIGS. 23 to 25 is inserted with a clamping part 75 into the cavity 72 of the basic section 70 and is secured with a not shown, wedge-shaped element fixable to the clamping part 75. A fixing to an adjacent vertical section 10, 11 is brought about by means of a fixing flange 78, which engages on the vertical sections 10, 11 and can be fixed by means of fixing openings 87 aligned with the T-slots 18 of the vertical sections 10, 11. This ensures a secure retaining and reinforcing action of the horizontal cable duct transverse beam 5 on an office or work place furniture item.

We claim:

1. A working table for work places comprising:

a front table top, at least one further working plane adjacent to said front table top, support arms, on which said table top and the further working plane are arranged, in vicinities of lateral edges of said table top and said further working plane, double support feet connected to the support arms, each of said double support feet having a front vertical section and a spaced, identically constructed, rear vertical section provided with outer T-slots and inner cavities, base elements at lower ends of the front and rear vertical sections, base connectors connecting the base elements of the front and rear vertical sections, a vertical adjustment device for the table top received in at least one of the inner cavities, horizontal foot brackets provided on each of said double support feet, cable ducts in a vicinity of the vertical sections, and a transverse beam, defining a horizontal cable duct in a vicinity of the table top, arranged as a stiffening connection between the vertical sections, the transverse beam interconnecting both the front vertical sections and the rear vertical sections and being fixed in the outer T-slots of the front vertical sections and the rear vertical sections by connecting elements, each of which is provided with a clamping part for insertion into a frontal cavity of the transverse beam and with a fixing flange for engaging on and fixing to the vertical sections, the at least one further working plane being fixable to the rear vertical sections.

2. A working table according to claim 1, wherein, as the further working plane, a rear table top is provided on the rear vertical sections, the rear table top arranged so as to be at least one of vertically and horizontally adjustable.

3. A working table according to claim 1, wherein the vertical adjustment device is telescopically constructed and includes an inner tube positioned in a central inner cavity of at least one of the vertical sections.

4. A working table according to claim 3 wherein the inner tube is lockable in steps at fixed heights in the central inner cavity and provided with sliding faces made from plastic.

5. A working table according to claim 3, wherein the vertical adjustment device for the table top incorporates an indicating device indicating fixed heights.

6. A working table according to claim 3, and further comprising sliding elements constructed for sliding guidance of the inner tube in the central inner cavity of the at least one of the vertical sections.

7. A working table according to claim 3, wherein the table top is vertically adjustable, and further comprising a control mechanism for controlling vertical adjustment of the table top arranged near the front of the table.

8. A working table according to claim 3, and further comprising at least one spindle guided in an inner space of one of the vertical sections.

9. A working table according to claim 3, and further comprising one pivot pin constructed in a connecting area of the inner tube cooperating with an associated one of said support arms.

10. A working table according to claim 3, wherein the vertical sections have almost rectangular cross-sections with bevelled or rounded corner areas, and the central inner cavity and the inner tube have rectangular and substantially complementary cross-sections.

11. A working table according to claim 3, wherein the inner tube is continuously vertically adjustable in the central inner cavity and provided with sliding faces made from plastic.

12. A working table according to claim 3, and further comprising a cylinder-piston unit in an inner space of one of the vertical sections to which the inner tube is connected.

13. A working table according to claim 1, wherein the transverse beam defining the horizontal cable duct is trough-shaped, coverable and fixed in an upper area of the vertical sections.

14. A working table according to claim 13, and further comprising a pivotable cover with a sealing cable guide, wherein the cable duct is arranged as a second working plane below a rear area of the front table top.

15. A working table according to claim 14, wherein the transverse beam defining the horizontal cable duct is formed from several longitudinal sections which are detachably interconnected on longitudinal edges thereof and at least one of said several longitudinal sections has a fastening area for fixing to the vertical sections.

16. A working table according to claim 15, wherein a hollow, bent basic section is provided as one of said longitudinal sections and has, as the fastening area, a cavity, and further comprising an arcuate cover pivotably provided on the basic section.

17. A working table according to claim 16, and further comprising a centrally positioned snap seat connection for connecting the basic section to a rear longitudinal section and a further hollow section for enlarging the cable inner space lockably provided by the snap seat connection, wherein the longitudinal sections are provided with webs and T-slots for a correct cable arrangement.

18. A working table according to claim 13, wherein the transverse beam defining the horizontal cable duct is provided with a cover which has a horizontal gap for introduction and removal of cables with a sealing cable bushing.

19. A working table according to claim 1, wherein the front table top is arranged in lockably horizontally slidable manner by a sliding plate guide which is provided with blocking elements and guided in a longitudinal channel of a support arm.

20. A working table according to claim 1, and further comprising plug-in and self-centering extension sections of the rear vertical sections defining a third plane and a cross-brace arranged between the extension sections and fixable thereto.

21. A working table according to claim 20, wherein an adjusting plane for equipment is fixed as a third working plane and is constructed in an inclination-adjustable manner, the adjusting plane defines an upper, horizontal cable duct, and the adjusting plane is provided with cable guiding elements and an adjustable casing bottom.

22. A working table according to claim 1 and further comprising a connection field provided as a third working plane in a rear area of the table top in an ergonomic gripping area of a gripping line, and monitors arranged in a pivotable manner on an extension section outside the table top and the connection field.

23. A working table according to claim 1, and further comprising a casing area provided as an additional working plane below the table top for receiving any of computers, plug-in cards and equipment modules, and an integrated cabling provided for items located in the casing area.

24. A working table according to claim 23, wherein the casing area is at least one of IP-tight and r.f.-shielded, and further comprising ventilating means for automatic ventilation of the casing area.

25. A working table according to claim 1, wherein a vertical cable duct is formed between the front vertical sections and the rear vertical sections with aid of a facing, which in the upper area has a lockable cable duct cap and a side cover, and the vertical cable duct is connected to the horizontal cable duct transverse beam.

26. A working table according to claim 1, and further comprising cupboard units provided below the table top and fixed near the double support feet.

27. A working table according to claim 1, and further comprising roll containers positioned with a stepped cover area adapted to the horizontal cable duct transverse beam and a front cover area provided for receiving attachments.

28. A working table according to claim 1, wherein at least the front vertical sections are connected to horizontally positioned foot brackets which are removable in a use position of the working table.

29. A working table according to claim 28 and further comprising a corner combination for connecting the working table with at least one other working table, said corner combination having double support feet provided in the vicinity of a corner plate.

30. A working table according to claim 28, and further comprising a base element provided for connection of at least one of the front vertical sections and the foot brackets, said base element being constructed for detachable, horizontal reception and fixing of the foot brackets.

31. A working table according to claim 30, wherein the base element has a recess into which one of the foot brackets is inserted with a connecting block so as to be fixed in a self-centering and self-arresting manner.

32. A working table according to claim 31, wherein the connecting block is located in a terminal area within one of the foot brackets and the base element has an easily accessible connecting area which is constructed for reception of a fastening element for an inclined screw fastening engaging on the connecting block.

33. A working table according to claim 30, wherein the base element is connected as a unit, with the aid of a base connector, to a second base element.

34. A working table according to claim 33, wherein the base elements are constructed as a casting and the foot brackets are constructed as deep-drawn steel parts.

35. A working table according to claim 33, wherein the base elements are constructed as a casting and the foot brackets are constructed as aluminum die castings.

* * * * *